United States Patent [19]

Clark et al.

[11] 4,220,157

[45] Sep. 2, 1980

[54] COUNTERWEIGHTED BRASSIERE FOR ATHLETIC USE

[76] Inventors: Harold E. Clark, Rte. 3, Box 136, Hendersonville, N.C. 28739; Paul T. Clarl, 70 Huron Ave., Cambridge, Mass. 02138

[21] Appl. No.: 964,277

[22] Filed: Nov. 28, 1978

[51] Int. Cl.[2] ..... A41C 3/00

[52] U.S. Cl. ..... 128/510

[58] Field of Search ..... 272/119, 29 D, 35; 128/510, 429, 425, 462, 520; 24/73 LG; 224/5 R, 8; 273/26 B, 189 R, 119; 2/49 R, 45, 44, 300

[56] References Cited

U.S. PATENT DOCUMENTS

| | | | |
|---|---|---|---|
| 1,598,838 | 9/1926 | Wilcott | 2/50 |
| 2,581,036 | 1/1952 | McIlhinney | 128/510 |
| 2,752,602 | 7/1956 | Wilhelm | 2/273 |
| 2,908,275 | 10/1959 | May | 128/425 |

FOREIGN PATENT DOCUMENTS

| | | | |
|---|---|---|---|
| 930754 | 7/1973 | Canada | 272/119 |

*Primary Examiner*—Doris L. Troutman

[57] ABSTRACT

A brassiere is provided in which weights which approximate the weight of the breasts are suspended from non-stretchable straps passing from the cup over the shoulders and down the back. The mass of each breast and its counterweight remain in dynamic equilibrium throughout athletic activity so that stress on breast tissue caused by activity-induced bouncing does not occur. The counterweight system also frees the brassiere design from the necessity of conventional chest-binding circumferential straps, making possible a looser and more comfortable design.

10 Claims, 2 Drawing Figures

COUNTERWEIGHTED BRASSIERE FOR ATHLETIC USE

The present invention comprises a design for a comfortable and therapeutic brassiere to be worn while engaging in athletic activity, particularly that involving running or jumping. Its particular purpose is to eliminate unpleasant and deleterious bouncing of the breasts as the wearer's foot strikes the ground.

Previous efforts to prevent this problem have concentrated on binding or otherwise constraining the breasts. Such methods are uncomfortable and tend to be avoided. In contrast, the subject invention eliminates all binding and uncomfortable constraint by invoking principles pertaining to force, mass and acceleration in a manner which counteracts adverse motion dynamically.

Adverse breast motion is that which occurs when a female subject has taken a running or jumping step and her foot returns to the ground. At this time, the torso stops, but the breast tends to continue its downward movement, which movement is stopped only by the tissue attaching the breast to the chest. The resulting strain on this tissue causes discomfort and eventually contributes to permanent sagging of the breast.

The kinetic principles of physics teach us what occurs in such a jumping or running situation. If, for example, the body rises 4 inches during an upward step, and upon return to contact to earth, the upper torso is brought to vertical rest within one inch after contact, the decelerative force required to bring this about is 4 times the acceleration of gravity, or 4 g's of force. That is, an acceleration is present equal to the ratio of the rise height to the stopping height. This means that the connective tissue holding the breast to the chest wall is subjected to an additional pulling force 4 times that which it must normally withstand.

The subject invention attacks this problem by adding a counterweight to a strap or support member for the breast. A firm non-stretchable cup is placed under and around the breast in a brassiere structure. The cup is attached to a non-stretchable strap which passes over the shoulder and down the back. Attached to the back end of the strap is a weight which approximates the weight of the breast. Leaving aside frictional contact of the strap to the body, the weight then supports the breast, as would be the case of two equal weights hanging over a pulley. However, it is its dynamic effect, not the static balance, which is basic to the concept.

The novel mode of achieving breast support makes possible further advantages and opportunities for improvement which arise from employment of the new principles. The conventional brassiere achieves firmness and control by binding the breasts, that is, by use of a tight strap closing around the back of the chest region. It is also common to further bind the chest in a firm strap passing under the breasts and around to the back. In the subject invention, where chest binding is no longer needed to constrain the breasts, a looser and more comfortable general design is made possible, on which is particularly well-suited to athletic activity. Since in the subject invention the breasts are supported by the shoulders, not circumferential straps, conventional chest binding is not necessary for support.

Figure 1:
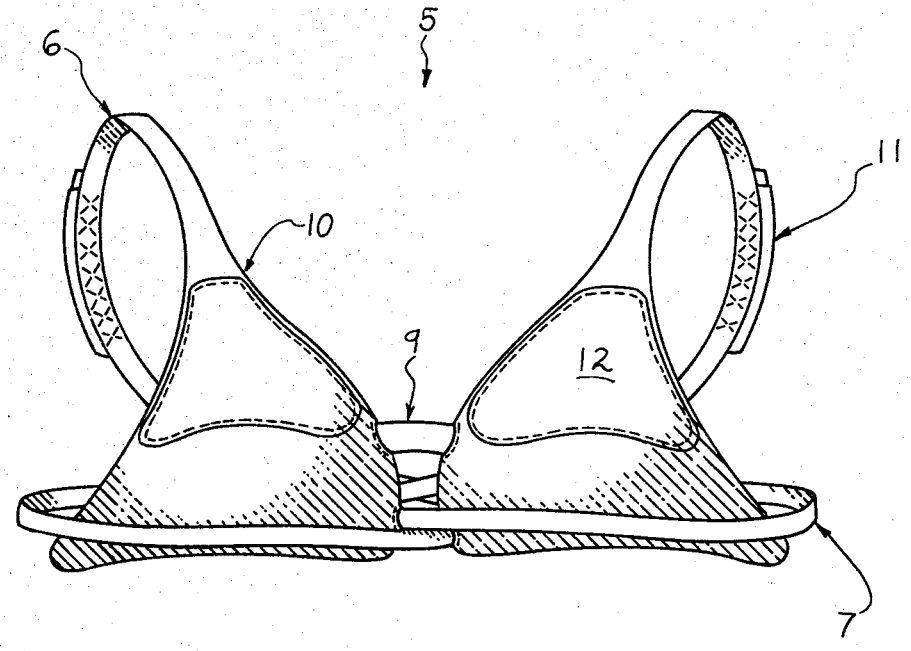
FIG. 1 is a front perspective view.
Figure 2:
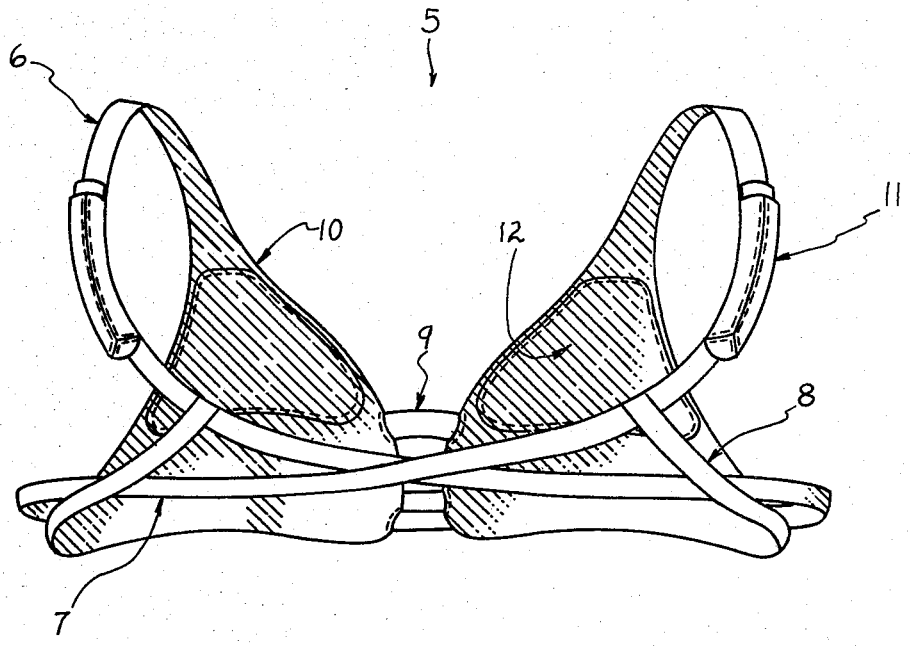
FIG. 2 is a back perspective view of a preferred embodiment of the invention.

In FIGS. 1 and 2 the brassiere 5 includes support straps 6 joined to horizontal straps 7 which cross in back without fastening, and each of which is joined in front to the cup 10 opposite from the cup it crosses. The cups are joined by strap 9, and straps 8 connect straps 7 with the cups. Attached to the back part of each strap is a weight 11 which approximates the weight of one breast.

When a female subject wearing the brassiere of FIGS. 1 and 2 takes a running step and her foot strikes the ground, the mass of a breast will continue to descend with the initial downward velocity until a decelerating force is exercized. Likewise, the weight attached at the back will also undergo deceleration. The decelerating force for both the breast and the weight will be supplied by the non-elastic strap 6 connecting the two masses over the shoulder; that is, the strap will exert an upward tensile force on each of the masses. In turn, the straps exert a downward force on the tops of the shoulders, and the shoulders supply forces supporting the straps. In other words, the dynamic loads of the breasts and weights are carried at the top of the shoulders, so that there is no load on chest tissue. Furthermore, even though the force varies from moment to moment, the forces on the breasts are always exactly balanced by the weights, and there is no relative motion between the breasts and the body. Neither the breasts nor the weights move downward with respect to the body; both remain against the body in the normal rest position. Hence the breast tissue is not stretched or fatigued by the exercize. This is the basic principle of the invention.

The low tension on all of the straps allows maximum unrestricted movement of the wearer's upper body during strenuous activity. Low tension is possible because the straps 7 and 8 keep the brassiere, not the breasts, in place. This non-restricting design follows as a consequence of the weights' 11 dynamic balancing of the breasts during movement.

There is almost no vertical movement of straps 6 with respect to the body, but the added dynamic load on the shoulder makes a wide strap, say 1 inch, desirable. Also, since the assembly can undergo secondary movements, it is desirable to minimize shoulder friction by making the straps of a slippery material, like satin, or by employing an underlayer between the straps and the shoulders. At the front, this underlayer attaches to the brassiere in a non-load-bearing manner.

The bottom portion of each cup 10 lightly supports the breast with no horizontal pressure, unlike conventional tightly-binding brassieres. Similarly, the upper part of each cup only functions lightly to confine the breast to counteract the slight force caused by each upward step, which causes upward breast motion. This force can be entirely counteracted by lightly padding the upper portion of each cup with compressible material such as cotton or foam. This compressible material 12 serves another function as well. Breasts supported in the counterweighted brassiere are, due to the different support system, shaped slightly differently from their shape in a conventional brassiere, so that the top part of a counterweighted breast in a conventionally-shaped cup does not fill the cup and some bouncing during activity can occur as a result. The compressible material 12 eliminates this motion. The motion could also be eliminated by redesigning the cup to be consistent with the reshaped breast.

The counterweights 11 are made of strips of dense material such as lead, so that bulk is minimized. Sets of pockets can be sewn into straps 6 so that weights can be slipped in or out as desired, providing adjustability.

A subject who normally wears a brassiere with a D cup size may have breasts which each weigh approximately 260 grams. A strip of lead (specific gravity 11.35) of corresponding weight has a volume of 2.3 cc (1.4 cubic inches); this is the volume of a lead strip 4.25 inches in height, 1.25 inches wide, and 0.25 inches thick. Two such strips incorporated into the brassiere of FIG. 1 or FIG. 2 prevent downward bouncing of a subject's breasts during athletic activity.

The strap arrangement illustrated in FIG. 2 is to be considered illustrative and non-restrictive. Variations within the scope of the invention are indicated by the claims.

What is claimed is:

1. A brassiere in which the support for the breasts comprises a pair of cups, a pair of straps each attached to one of said cups and passing over a shoulder of the wearer, and a pair of weights each of which approximates the weight of a breast and is attached to a respective one of said straps at a point over the shoulder on the back of the wearer.

2. A brassiere in which support for the breasts comprises cups attached to straps which pass over the shoulders and from which are suspended weights which approximate the weight of the breast, said straps including horizontal strap portions joining the brassiere cups across the front and the back and exerting only light tension sufficient to hold the brassiere in place.

3. A brassiere in which the support for the breasts comprises cups attached to straps which pass over the shoulders and which includes generally vertical strap portions from which are suspended weights which approximate the weight of the breasts, said straps including horizontal strap portions in back joined to the vertical strap portions supporting the weights, crossing each other with no attachment, extending around the chest, and joined in light tension at the front.

4. A brassiere in which the support for the breasts comprises cups attached to straps which pass over the shoulders and which includes generally vertical strap portions from which are suspended weights which approximate the weight of the breasts, said straps including horizontal strap portions in the back joined to the vertical strap portions supporting the weights, crossing each other with a sliding attachment, extending around the chest and joined in light tension at the front.

5. A brassiere in which the support for the breasts comprises cups attached to straps which pass over the shoulders and which include generally vertical strap portions from which are suspended weights which approximate the weight of the breasts, said straps including horizontal strap portions in the back joined to the vertical strap portions supporting the weights, crossing each other with a sliding attachment, extending around the chest and each joined in light tension to the brassiere cup opposite the cup it crosses.

6. A brassiere in which the support for the breasts comprises cups attached to straps which pass over the shoulders and which include generally vertical strap portions from which are suspended weights which approximate the weight of the breasts, said straps including horizontal strap portions in the back joined to the vertical strap portions supporting the weights, crossing each other, extending around the chest and each joined in light tension to the brassiere cup opposite the cup it crosses.

7. The brassiere of claim 1 in which each of said straps includes a generally vertical portion extending from a respective said cup over a said shoulder and to which is attached a said weight, and a generally horizontal portion extending from the back around to the chest of the wearer.

8. The brassiere of claim 7 in which each of said horizontal strap portions is joined to the cup to which the vertical strap portion thereof is attached.

9. The brassiere of claim 1 in which said cups and straps are substantially non-stretchable.

10. The brassiere of claim 7 including a second pair of straps, each strap of said second pair being attached to a lower portion of a said cup and to the strap of said first mentioned pair the generally vertical portion of which is attached to said cup.

* * * * *